US006295670B1

(12) United States Patent
Schieberl

(10) Patent No.: US 6,295,670 B1
(45) Date of Patent: Oct. 2, 2001

(54) BED COVERING RETENTION APPARATUS

(76) Inventor: Daniel L. Schieberl, 1905 San Miguel Rd., Santa Rosa, CA (US) 95403

( * ) Notice: Subject to any disclaimer, the term of this patent is extended or adjusted under 35 U.S.C. 154(b) by 0 days.

(21) Appl. No.: 09/564,747

(22) Filed: May 4, 2000

(51) Int. Cl.[7] ..... A47C 21/02

(52) U.S. Cl. ..... 5/504.1; 5/658; 5/496; 5/498; 24/72.5

(58) Field of Search ..... 5/504.1, 503.1, 5/658, 659, 496, 498; 24/72.5

(56) References Cited

U.S. PATENT DOCUMENTS

| | | | | |
|---|---|---|---|---|
| D. 387,602 | | 12/1997 | Cerdan | D6/607 |
| 2,321,394 | * | 6/1943 | King | 24/72.5 |
| 2,459,497 | * | 1/1949 | Calabro | 5/498 |
| 2,931,084 | * | 4/1960 | De Witt | 24/72.5 |
| 4,199,830 | * | 4/1980 | Ogata | 5/498 X |
| 4,662,016 | * | 5/1987 | Seeman | 5/658 |
| 4,679,265 | * | 7/1987 | Wicks | 5/658 X |
| 4,782,543 | * | 11/1988 | Hutton et al. | 5/658 |
| 4,829,617 | * | 5/1989 | Dameron | 5/498 X |
| 5,014,399 | | 5/1991 | Grisel | 24/72.5 |
| 5,072,470 | | 12/1991 | Lysiak | 5/496 |
| 5,148,560 | * | 9/1992 | Torres | 5/496 |
| 5,160,306 | * | 11/1992 | Lui | 5/658 X |
| 5,377,391 | | 1/1995 | Foster | 24/72.5 |
| 5,404,602 | * | 4/1995 | Kondo | 5/504.1 |
| 5,467,491 | * | 11/1995 | Griffith | 5/658 |
| 5,974,606 | * | 11/1999 | Moberly | 5/658 X |

* cited by examiner

*Primary Examiner*—Lynne H. Browne
*Assistant Examiner*—Robert G. Santos
(74) *Attorney, Agent, or Firm*—Johnson & Stainbrook LLP; Larry D. Johnson; Craig M. Stainbrook

(57) ABSTRACT

A bed covering retention apparatus comprising a planar anchor plate having a proximal portion and a distal portion, an upper surface and a lower surface, a first and a second anchor point at the proximal end of the anchor plate to which first and second elastic bands are removably connected. The first and second elastic bands have a proximal end and distal end and extend from the anchor points along the bottom surface of the anchor plate until each emerges upwardly through respective apertures to the top surface of the anchor plate. The bands further include releasable jaws having an adjustable opening and adjustable tension so that the jaws will clamp securely to sheets and covers of varying thicknesses. The elastic bands are of differing lengths, one being suited to clamping to an innermost bed covering and the other for clamping to coverings above the innermost covering

6 Claims, 5 Drawing Sheets

BED COVERING RETENTION APPARATUS

BACKGROUND OF THE INVENTION

1. Field of the Invention

The present invention relates generally to devices for securing bedding to either conventional or waterbed mattresses, and more particularly to a bed covering retention apparatus that simultaneously secures top sheets and upper blankets or coverings.

2. Discussion of Related Art

High quality sheets and other bed coverings, such as down and satin comforters, have smooth, slippery fabric finishes. In consequence, sheets and covers tend to slide easily relative to one another, and when one or more bed occupants sleep fitfully and restlessly, the bedding may be entirely displaced from the bed. It is not uncommon for children to kick off the covers during the night, and a common complaint from one bed partner to another is that the offender "steals" the covers. It is probably not an exaggeration to suggest that this has seriously strained some relationships, and it unquestionably causes simple discomfort on a routine basis.

Numerous solutions have been proposed to address this problem, including the following:

U.S. Pat. No. 5,377,391 to Foster discloses a bed covering retaining device comprising a central band of stiff, smooth material and elastic straps attached to opposite ends of the band, and openable and lockable fasteners with jaws attached to the ends of the straps. The device is placed under a mattress and the fasteners are clamped to opposite sides of the cover.

U.S. Pat. No. 5,014,399 to Grills discloses a sheet fastening assembly for releasable securing sheets to an object. Included in the assembly is an anchoring device, an interconnecting device and a sheet fastener. The sheet fastener includes a sheet grasping member which is slideable within a slot defined by a clasping member of the fastener for releasable securing sheet material therebetween. The slidable sheet grasping member is provided with locking tabs for releasable locking the slidable member in a sheet engaging position.

U.S. Pat. No. 5,072,470 to Lysiak teaches a device for holding bedclothes in a fixed position on a bed, the device comprising three component parts all positioned under the topmost mattress of the bed. The three parts include: a) an anchor member having a plurality of cooperable fastening means disposed generally at peripheral points on it, the fastening means counter poised against one another; b) a plurality of elasticized retaining members having length adjusting mechanism and cooperable fastening means to those on the anchoring member; and c) a plurality of clamps having pivotally connected gripping segments, a closure forcing element and cooperably insertable associated independent coupling elements, said clamps connected to the retaining members. Any number of bedclothes, at any point adjacent to the lower edge of the uppermost cushioned structure, are wrapped around an associated independent coupling element and the associated independent coupling element and bedclothes are then inserted into the clamps. The bedclothes are then tucked under the uppermost cushioned structure of the bed and the elasticized retaining hand is then fastened to the anchoring member the cooperable fastening means. The bedclothes are fastened to the device at opposite sides of the bed and are so held in place by the device through opposing counterpoised force.

Although the proposed solutions provide the general means to secure bedding, each suffers deficiencies not present in the instant invention. For example, both the '391 patent and the '399 patent are not suitable for convenient fastening of a plurality of covers. Furthermore, the '391 patent and the '470 patent are designed to secure covers through counterpoised force, the latter comprising a network of bands. This requires that bands and/or anchor members be positioned either transversely or longitudinally along the bed so that each fastening member have a counterpart on the opposite side of the bed.

The present invention overcomes the limitations of existing devices.

SUMMARY OF THE INVENTION

The bed covering retention apparatus of the present invention comprises a planar anchor plate having a proximal portion and a distal portion, an upper surface and a lower surface, and two anchor points at the proximal end of the anchor plate to which elastic bands are removably connected. The first and second elastic bands have a proximal end and distal end and extend from the anchor points along the bottom surface of the anchor plate until each emerges upwardly through respective apertures. The bands further include releasable jaws having an adjustable opening and adjustable tension so that they can be clamped securely to sheets and covers of varying thicknesses.

The elastic bands are preferably of differing lengths so that one is suited to clamping to an innermost bed covering and the other for clamping to and securing coverings above the innermost covering.

DETAILED DESCRIPTION OF A PREFERRED EMBODIMENT

Figure 1:
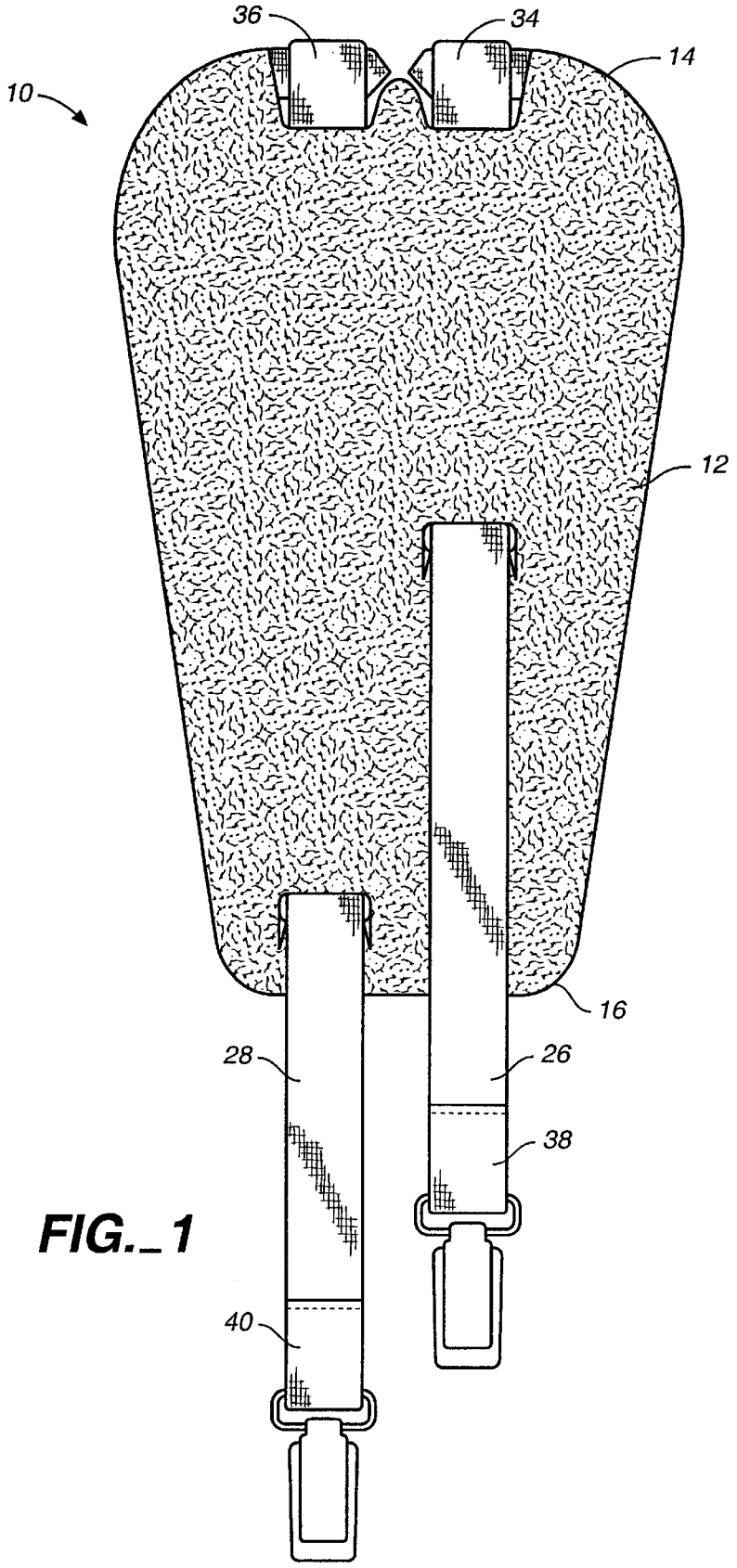
FIG. 1 is a top view of the anchor plate of the bed covering retention apparatus of the present invention.
Figure 2:
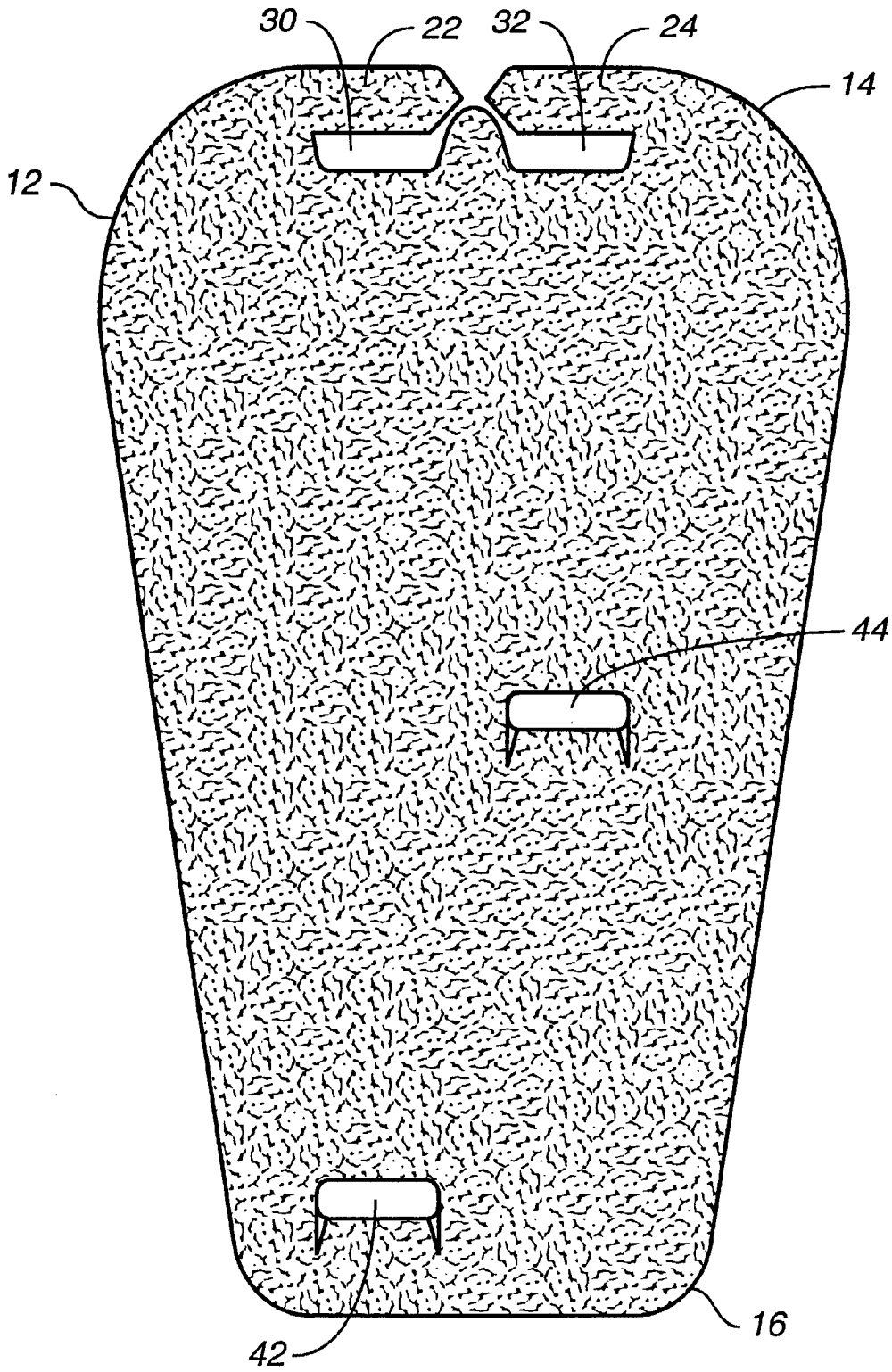
FIG. 2 is a top view of the retention apparatus, including its elastic bands.
Figure 3:
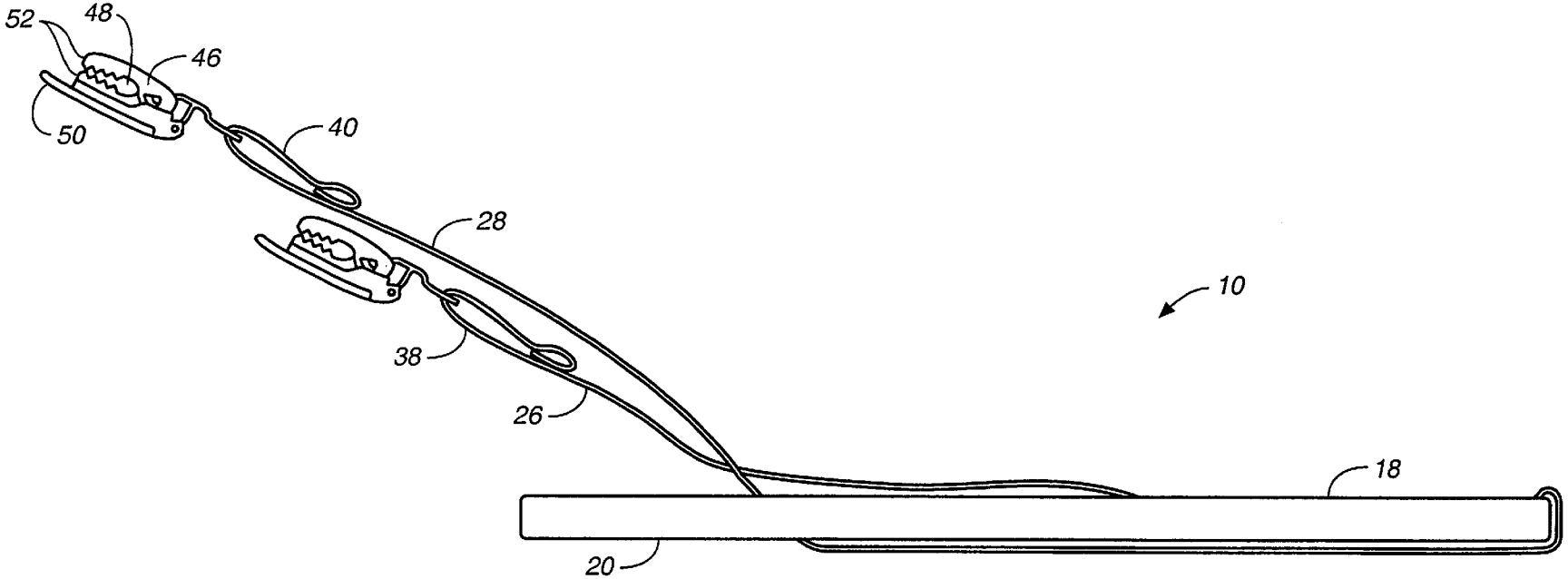
FIG. 3 is a side elevation view of the retention apparatus, particularly showing the elastic bands and the releasable, lockable jaws of the inventive apparatus.

FIG. 1 is a top view of the bed covering retention apparatus 10 of the present invention. FIG. 2 is a top view of the anchor plate 12 of the retention apparatus of FIG. 1, and FIG. 3 is a side elevation view of the retention apparatus. These views show that the apparatus comprises a substantially planar anchor plate 12, which may be of any of a number of suitable shapes, but which preferably has a wide proximal portion 14 and tapers slightly to a narrower distal portion 16. The anchor plate has an upper surface 18, a lower surface 20, and two anchor points, 22 and 24, at the proximal end of the anchor plate to which a first and a second elastic band, 26 and 28 respectively, are removably connected. Preferably the anchor points 22 and 24 comprise simple arms defined by notches, 30 and 32, cut into the distal portion of the anchor plate. The first and second elastic bands have a looped proximal end, 34 and 36, respectively, and looped distal ends, 38 and 40, and are each connected to one of the arms via their respective loop portion. The elastic bands extend from the anchor points along the bottom surface of the anchor plate until the first band emerges upwardly through a first aperture 42 and the second band through a second aperture 44. Preferably, the first aperture is located more closely to the proximate end of the anchor plate than is the second aperture.

Bands 26 and 28 further include bed covering fastening means connected at their respective distal ends. Any of a number of suitable clamping devices may be used as the fastening means, but preferably the fastening means comprises a releasable and lockable jaw member, 46, the opening 48 and tension on which may be easily adjusted to accommodate sheets and covers of varying thicknesses, via locking tab 50 which biases the jaws 52 shut when in the closed position and open when in the open position.

Figure 4:
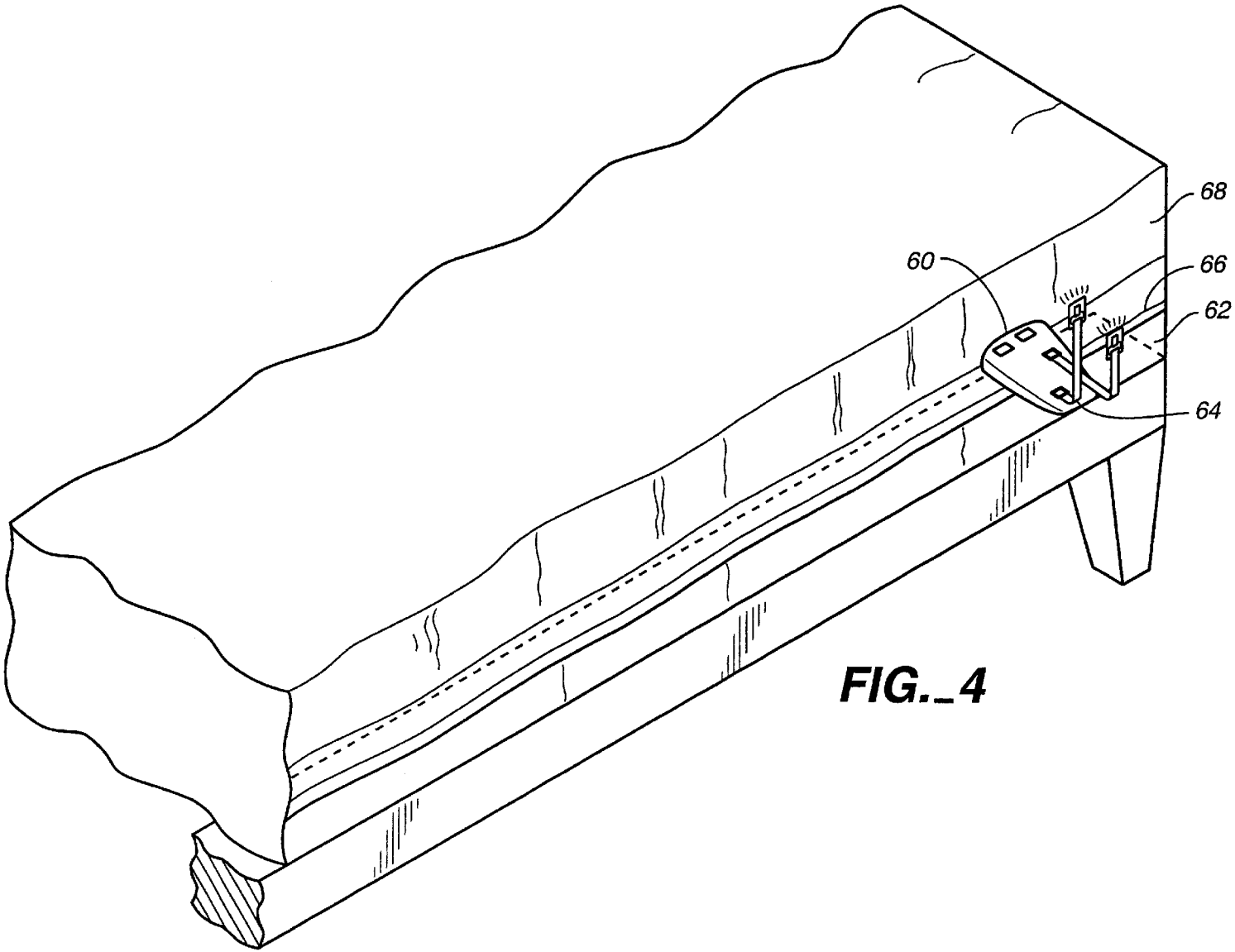
FIG. 4 is a perspective view of showing the apparatus of FIG. 2 positioned under the upper mattress of a bed with clamps fastened to differing covers.

FIG. 4 is a perspective view of showing the apparatus 60 of FIG. 2 positioned under the upper mattress of a bed with clamps fastened to differing covers. Preferably the elastic bands are of differing lengths, and more preferably first elastic band 62 is shorter than second elastic band 64, the former for clamping to and securing a top sheet (or an innermost bed covering) 66, and the second band for clamping to and securing any covering 68 or coverings above or on top of the innermost covering. Although this is the intended use of the elastic bands of differing lengths, it will be readily appreciated that there is nothing imperative in this particular use and that the bands are perfectly adapted for use on a bed with a single cover or sheet or multiple covers. The anchor plate may be sized at roughly the hand size of an average adult male. These features make the inventive apparatus easy to tailor to the needs of particular users, and especially easy for children to use to make their beds.

Figure 5:
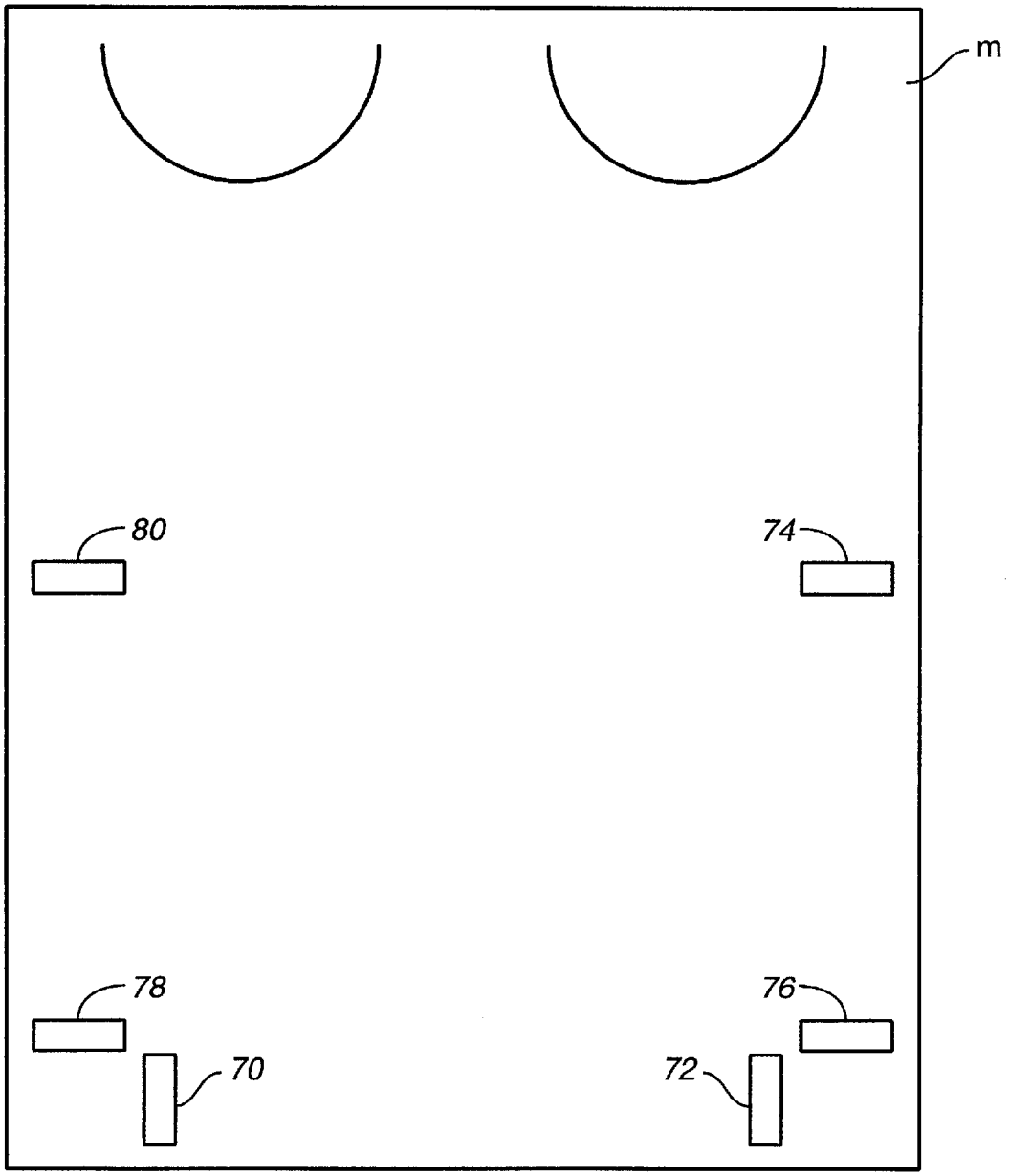
FIG. 5 shows a possible configuration of the apparatus located around the perimeter of a mattress.

Ordinarily several bed covering apparatus are used to secure the covers of a bed. FIG. 5 shows a possible configuration of device locations around the perimeter of a mattress M, showing end positions, 70 and 72, and side positions 74, 76, 78, 80. The apparatuses are simply inserted between a box spring and to mattress, or underneath any kind of upper mattress, and the various apparatuses are positioned to suit the needs or predilections of the users. Side pieces can be positioned anywhere from the foot of the bed to close to the head of the bed, depending on how tight the user wishes the covers to be and how warmly he or she wishes to sleep. The bands may be stretched tightly and clamped onto the coverings to provide a snug feel in the bed, or they can be kept relatively loose to prevent covers from being pulled down or off the bed, while also providing the sleeper with room to move about freely.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A bed covering retention apparatus for simultaneously securing a plurality of bed coverings, comprising:

an anchor plate having a proximal end, a distal end, an upper surface and a lower surface, a first and second anchor point at said proximal end, and first and second apertures passing from said bottom surface to said top surface;

a first and a second elastic band, each having a proximal end and a distal end, and each removably connected at their respective proximal ends to said first and second anchor points, said first elastic band extending from said first anchor point and said second elastic band extending from said second anchor point along said bottom surface, said first band emerging upwardly through said first aperture and said second band emerging through said second aperture; and a first and second fastening means connected to said first and second distal end of said first and second elastic band.

2. The apparatus of claim 1 wherein said fastening means comprises releasable, lockable jaw members.

3. The apparatus of claim 1 wherein said first elastic band is shorter than said second elastic band.

4. The apparatus of claim 3 wherein said first aperture is located closer to said proximal end of said anchor plate than is said second aperture.

5. The apparatus of claim 1 wherein said anchor plate is substantially planar.

6. The apparatus of claim 5 wherein said anchor plate tapers from its proximal end to its distal end.

* * * * *